US006833101B2

(12) United States Patent
Bittner

(10) Patent No.: US 6,833,101 B2
(45) Date of Patent: Dec. 21, 2004

(54) METHOD FOR MAKING A PLASTIC MESH STRUCTURE

(75) Inventor: Hans-Joachim Bittner, Brake, DE (US)

(73) Assignee: Norddeutsche Seekabelwerke GmbH & Co., Nordenham (DE)

( * ) Notice: Subject to any disclaimer, the term of this patent is extended or adjusted under 35 U.S.C. 154(b) by 436 days.

(21) Appl. No.: 10/145,348

(22) Filed: May 13, 2002

(65) Prior Publication Data

US 2002/0185772 A1 Dec. 12, 2002

Related U.S. Application Data

(63) Continuation-in-part of application No. 09/276,284, filed on Mar. 25, 1999, now abandoned.

(30) Foreign Application Priority Data

Mar. 27, 1998 (DE) ..... 198 13 619

(51) Int. Cl.[7] ..... B29C 59/02; B29C 43/02; B29D 28/00; B65B 13/02; B65D 71/06

(52) U.S. Cl. ..... 264/293; 264/132; 264/284; 264/296; 264/320; 264/322; 264/324; 264/DIG. 81; 156/209; 156/DIG. 19; 206/459.5; 206/497; 206/597

(58) Field of Search ..... 264/132, 284, 264/293, 296, 320, 322, 324, DIG. 81; 156/209, DIG. 19; 206/497, 597, 459.5

(56) References Cited

U.S. PATENT DOCUMENTS

| | | | | |
|---|---|---|---|---|
| 2,682,687 A | | 7/1954 | Franz | 264/80 |
| 3,366,052 A | | 1/1968 | Polansky | 101/485 |
| 3,392,080 A | | 7/1968 | Mercer | 428/134 |
| 3,642,967 A | | 2/1972 | Doll | 264/51 |
| 3,781,183 A | | 12/1973 | Doll | 428/136 |
| 3,790,652 A | | 2/1974 | Colijn | 264/146 |
| 3,917,889 A | | 11/1975 | Gaffney | 428/36.1 |
| 3,961,011 A | | 6/1976 | Bramley | 264/151 |
| 4,196,534 A | * | 4/1980 | Shibamoto | 40/665 |
| 4,332,326 A | | 6/1982 | Kelly | 206/497 |
| 4,402,409 A | * | 9/1983 | Slocumb | 206/597 |
| 4,636,162 A | | 1/1987 | Pavy | 425/240 |
| 4,741,442 A | * | 5/1988 | Slocumb | 206/597 |
| 4,887,719 A | * | 12/1989 | Kapke | 206/597 |
| 4,911,872 A | | 3/1990 | Hureau | 264/146 |
| 5,092,468 A | * | 3/1992 | Slocumb | 206/597 |
| 5,436,052 A | * | 7/1995 | Basse et al. | 428/109 |
| 5,639,543 A | | 6/1997 | Isoda | 428/220 |
| 5,715,943 A | * | 2/1998 | Thompson, Jr. | 206/363 |
| 5,733,825 A | | 3/1998 | Martin | 442/361 |
| 2002/0088533 A1 | * | 7/2002 | Mercure et al. | 156/179 |
| 2003/0072918 A1 | * | 4/2003 | Andersson | 428/156 |

FOREIGN PATENT DOCUMENTS

| | | |
|---|---|---|
| CH | 380648 | 5/1960 |
| DE | 2031764 C3 | 6/1970 |
| DE | 3017165 C2 | 5/1980 |
| DE | G9205373.4 U1 | 4/1992 |
| DE | 4436159 C2 | 10/1994 |
| FR | 1210534 A | 3/1960 |
| FR | 2572991 A | 5/1986 |
| FR | 2584651 A | 1/1987 |
| GB | 1410392 | 2/1973 |
| WO | WO 95/21117 A1 | 8/1995 |

* cited by examiner

*Primary Examiner*—Michael P. Colaianni
*Assistant Examiner*—Michael I. Poe
(74) *Attorney, Agent, or Firm*—Technoprop Colton LLC

(57) ABSTRACT

A process for producing an object made from plastic material with a mesh structure, wherein the mesh structure is deformed in at least one defined area, in such a manner that the original mesh structure of the area is eliminated and an essentially continuous structure and information can be introduced in this area.

28 Claims, 2 Drawing Sheets

METHOD FOR MAKING A PLASTIC MESH STRUCTURE

CROSS-REFERENCE TO RELATED APPLICATIONS

This application is a continuation-in-part of U.S. patent application Ser. No. 09/276,284 filed on Mar. 25, 1999, now abandoned, which claims priority under 35 USC §119 of German Patent Application No. 19813619.6 filed on Mar. 27, 1998.

BACKGROUND OF THE INVENTION

1. Technical Field

The invention relates to a method for producing an object made from a plastic material with a mesh structure and to the object produced therefrom.

2. Prior Art

Objects made from plastic material are used to protect sensitive components that are transported, for example, on pallets or in containers. These objects, which are often formed as covers, mats or sleeves, can be provided as intermediate layers or as sheaths between layers of components. A typical object can comprise a lattice structure that has been produced by extrusion and is formed from intersecting strands, the strands running perpendicular or with an inclination with respect to one another at the intersection points. The strands are usually arranged in two preferably parallel planes, in such a manner that in each plane the strands are aligned parallel to one another.

Thus, for example, bought-in parts for the automotive industry are conveyed in layers inside containers, covers or mats made from plastic with a mesh structure being provided between each of the individual layers. Notes that are easily legible and are simple to fix to the object are advantageous in order to be able to identify the covered parts or the properties of the object that forms the cover, mat or sleeve.

BRIEF SUMMARY OF THE INVENTION

The invention is a method for producing an object, in particular a cover, mat or sleeve, made from a plastic having a mesh structure which incorporates an area for identification information. The object is produced from a plastic mesh structure by forming a generally continuous surface over at least a defined portion of the mesh structure onto which identification or other information can be placed, by, for example, imprints, writing, stickers, or the like.

The object according to the invention is distinguished by at least one surface that is an integral part of the mesh structure. In the area of the surface, which is at a predefined location on the mesh structure, the original mesh structure is eliminated and, instead, an essentially continuous surface is present. Information, notes or the like can be arranged on this surface and can be used, for example, to identify or explain the components covered by the object. It is possible to apply an adhesive, to print on the surface, to stamp the surface and/or to form symbols in the surface. Symbols may also be introduced into the surface by means of cutouts or the like. The surface, or each surface if more than one surface is created, in which area, according to the invention, the mesh structure of the object has been eliminated, can also be referred to as the identification surface. Moreover, it is conceivable for the surface to serve as a support for or to receive any desired parts.

The method for producing the object is distinguished by the fact that the mesh structure of the object to be produced is deformed in the area of at least one defined surface. This deformation is so extensive that the original mesh structure in the area of the defined surface in question is eliminated and is essentially replaced by a continuous surface. Therefore, the mesh structure material that is present is the area of the surface to be produced is deformed in such a manner that it forms the surface in question. Specifically, the mesh structure is compressed, generally in the presence of heat, such that the strands of the mesh deform into the interstices between mesh strands, ultimately touching and binding with adjacent strands to form a continuous surface. Therefore, according to the method of the invention, no additional material is required to form the surface or even a plurality of surfaces.

The surface preferably is formed from the mesh structure by means of deformation, in particular as a result of pressure and/or heat. This means that the material forming the mesh structure is heated or compressed until a continuous surface is formed. The definition "continuous surface" does not mean that a completely smooth and homogeneous surface structure need be present. It is acceptable if some interstices remain in the continuous surface, even if the surface is not completely continuous. The important factor is that the surface formed be sufficient to serve as a base or support for the information, symbols, writing, stickers, or other items that are to be applied or introduced. If the purpose of the surface requires, it should be possible for an adhesive to be able to adhere sufficiently firmly to this surface. This may be possible even if the apertures present in the mesh structure are not completely closed.

The surface formed generally and preferably is sufficiently less high or thick thinner) than the remaining mesh structure. The height of the latter mesh structure corresponds to the thickness of the two superposed strand layers. By contrast, the material that has been displaced into the spaces in the mesh structure during the formation of the continuous surface means that the surface is significantly less thick. The surface may be planar or deformed or present deformations.

The invention also may be used for sleeves or pockets formed from a mesh structure, for example for protecting rotationally symmetrical or rod-like objects, such as shafts, pins or the like. Sleeves of this nature also may be applied to a pin, which serves as a support, in order to form the identification surface using a ram that has appropriate contours.

Further features of the invention will become more apparent to those of ordinary skill in the art from the remaining description and form the claims. Exemplary embodiments of the invention are explained below with reference to the drawings in which like reference numerals represent like components throughout the several views.

DETAILED DESCRIPTION OF THE PREFERRED EMBODIMENTS

Figure 1:
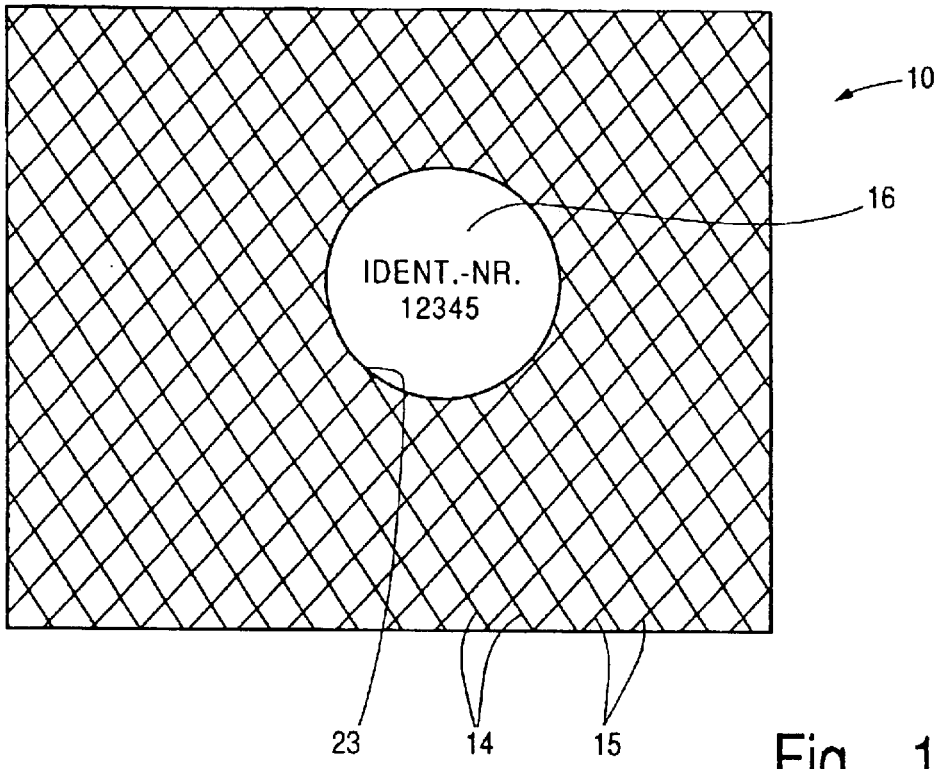
FIG. 1 shows a plan view of a cover with an identification surface according to the invention.

Typical plastic mesh structures used in the transportation of articles, particularly sensitive or fragile articles have an inherent degree of elasticity. Part of the elasticity may come from the plastic material of manufacture and at least part of the elasticity comes from the mesh structure itself. Specifically, a mesh structure comprising relatively thin strands and open spaces (such as the typical grid mesh structure) exhibits elasticity in both the X- and Y-directions along the plane of the mesh structure due to the deforming of the grid.

The present method results the formation of a thin walled, continuous surface that retains at least a portion of the elasticity of the original mesh structure. In the past, one of ordinary skill in the relevant art would refrain from forming a continuous surface by stamping the mesh structure because it was not expected that the available material of the mesh structure is sufficient for this purpose. Because packing materials generally have a mesh structure, it generally was expected that the stamping of the packing with a heated ram would disrupt the mesh surface and render it useless for packing. However, in the present invention it has been found that this is not the case, and the resultant thin-walled continuous surface retains at least a portion of the original elasticity of the original mesh structure. This resultant formation from the claimed method is a nonobvious and unexpected to those of ordinary skill in the art.

The method generally results in the formation of a thin-walled, continuous surface using the material of the mesh structure that has the advantage of retaining its elastic structure. This retention of elasticity in the continuous surface is important because mesh structures with elasticity are generally employed for packing or for protecting sensitive objects. The elasticity of the packing material allows for improved protection of packed objects, greater ease of use, and less chance of ripping or tearing of the mesh structure due to the formation of the thin-walled continuous surface.

The present invention provides a method for introducing information onto a mesh structure, used for example to protect sensitive equipment, which does not involve the complete melting of the structure's material to convey information. More specifically, the present invention allows one to introduce information onto a formed surface of mesh packing material by mean of stamping with a heated ram; the information can be introduced stamping the surface of the material. For example, the present invention allows the mesh structure to be directly labeled and replaces the need for stickers and tags for such labeling. Thus, additional material is not need to for the labeling of the units and there is a reduced risk the label will not be on the unit. Further, the present invention allows for the information to be introduced without a disruption to the surface of the mesh material, i.e. allows the mesh material remains continuous. Very specifically, the method allows the formation of a base where such information can be applied.

The present invention is distinct from common embossing methods. Although the present method does involve stamping directly onto a lattice, one advantage of the present method is that it allows the user to create a base onto which information can be placed. Further, the user does not need to expend many resources creating the defined area because it is just a stamp.

The method generally results in the formation of a thin-walled, continuous surface using the material of the mesh structure, and retaining at least some of the elastic structure of the mesh material. This retention of elasticity in the continuous surface is important, and unexpected, because mesh structures are generally employed for packing or for protecting sensitive objects. For this reason, there is a need for a high degree of flexibility and elasticity.

Referring now to the FIGS., an approximately rectangular cover 10 is used to cover and protect mechanical components. In an example, such a cover 10 can be transported in containers or on pallets. By way of example, the cover 10 is laid on a layer of components in a container before a further layer of components is added.

The cover 10 preferably can be produced from a thermoplastic material, specifically from two layers 12, 13 that are joined together in the region of intersection points 11, with each layer 12, 13 comprising mutually parallel strands 14, 15. These strands are formed by extrusion and, in the area of the intersection points 11, adhere to the strands of the other respective layer.

An identification surface 16 or a surface that is provided as a support or to be laid on top is formed in the cover 10. In the present illustrative example shown in the FIGS., this surface is virtually circular, but the surface can have any desired form, such as oval, square, triangular or other geometric or non-geometric shapes. In general, the identification surface may be formed by any suitable method, with heat or compression or a combination of heat and compression being preferred.

In the illustrative example, the identification surface 16 is formed by a heated round ram 17 that is positioned with a slight pressure on a defined portion of the cover 10 until the mesh structure formed by the strands 14, 15 has been largely removed (that is reformed from strands into a generally flat continuous surface) and said identification surface 16 has been formed. The pressure of the ram 17 on the two layers 12, 13 eliminates (that is reforms) the mesh structure by displacing the material of the strands 14, 15 into the spaces 18 between the strands 14, 15 that are otherwise present. In this way, the continuous surface 16 is formed. The ram surface 24 preferably is of planar design, as is the surface 16 formed. Other forms, for example with recesses, depressions and projections, are possible.

The ram 17 interacts with a support 19 that acts as a mating die. This mating die is of corresponding design to the ram, and preferably is without recesses, depressions or the like. As a result, an underside 20 of the compressed section 21 of the identification surface 16 being formed ends approximately flush with the bottom layer 13. In contrast, a top side 22 of the section 21 is offset inwardly with respect to the upper layer 12. Depending on the mesh width of the mesh structure, a shoulder 23 may appear in the direction of the underside 20 and as a circumferential rim of the compressed section 21.

The heat and/or pressure applied to the ram 17 are dependent on the material of the cover 10 and on the desired density or the desired structure of the identification surface 16. A thermoplastic can be melted and transformed from a mesh structure to a continuous identification surface in a simple manner and/or in a short time. A particular advantage of this process is that there is no need to add any material. All that happens is that the existing material is reshaped.

Figure 2:
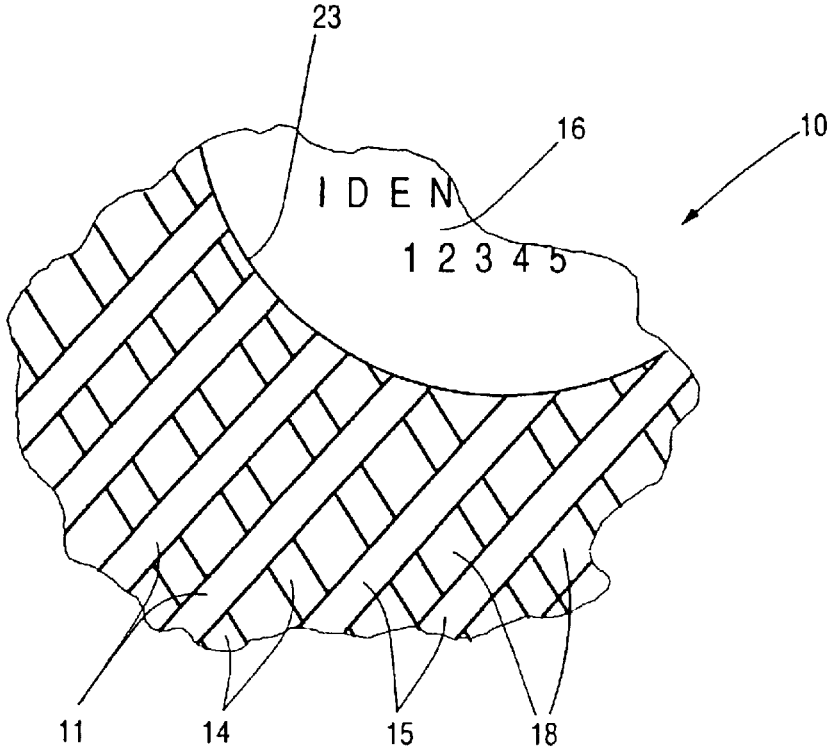
FIG. 2 shows an enlarged plan view of the cover in accordance with FIG. 1.

In a separate operation or during the reshaping of the mesh structure, the identification surface 16 can be provided with a marking, for example with information about the components that are to be protected by the cover 10. The ram 17 may, for example, stamp the appropriate information into the identification surface 16 during the reshaping operation. A possible application shown in FIGS. 1 and 2 is the provision of an identification number.

The marking is preferably applied to the inwardly offset top side 22. This provides additional protection for the marking against damage, for example from further largearea, heavy components that have been placed on top of the identification surface 16 specifically and the cover 10 generally. Information also can be applied to the identification surface 16 or the top side 22 or underside 20 subsequently, for example by stamping, printing or adhesive bonding. In each case, applying this information is easier than if the mesh structure alone were to be present.

In an embodiment that is not shown, a sleeve in the form of a tube, jacket or pocket is provided instead of a cover 10. This too can be provided with an identification surface 16 by using suitable tools. For example, a sleeve for protecting a shaft can be reshaped so as to form an identification surface 16, by introducing a mandrel and a ram that acts on the outside, in virtually the same way as the cover 10.

The individual strands 14, 15 within each layer 12, 13 preferably are at equal distances from one another. For example, in each layer, approximately 10 to 12 plastic strands lie next to one another for every 10 cm (that is, a strand density of 10 to 12 strands per 10 cm has been found to be a suitable density for the mesh structure). The diameter of each of the strands is approximately 0.5 to 5.0 mm, and preferably approximately 1.0 to 3.0 mm. To achieve the mesh structure, the strands 14 of one layer 12 are directed in a transverse or inclined manner with respect to the strands 15 of the other layer 13, see in particular FIG. 1.

Figure 3:
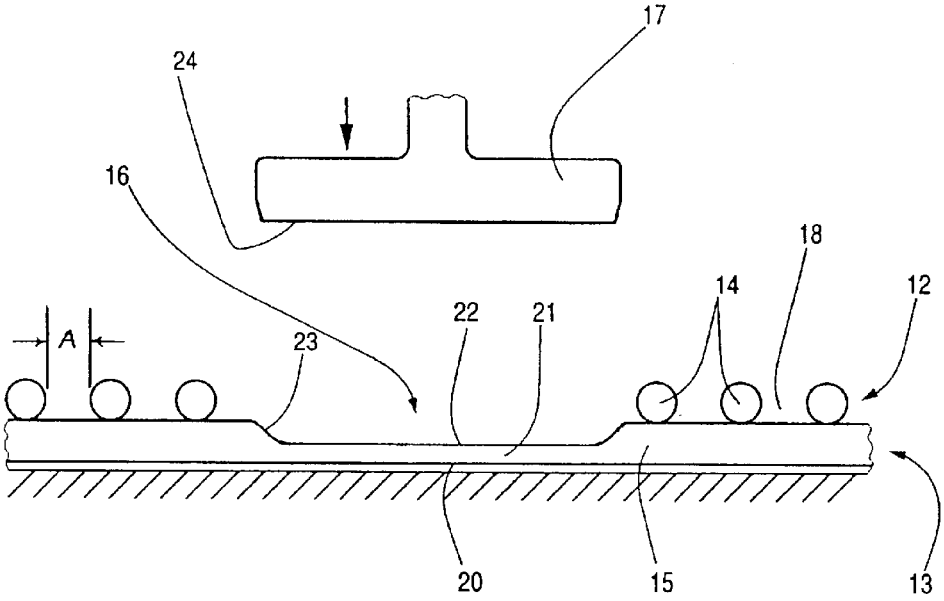
FIG. 3 shows an enlarged cross section through a cover in accordance with FIG. 1 after an identification surface has been produced using a ram-like tool.

The distance A, as shown in FIG. 3, between adjacent strands 14, 15 is approximately 0.5 to 5.0 times the diameter of the strands 14, 15. Thus, for example, for a strand 14, 15 having a diameter of 3 mm, the distance A between two adjacent strands lies in the range of 1.5 to 15 mm. Preferably, the distances between adjacent strands 14 and adjacent transverse strands 15 are equal, thus creating a square space 18 bounded by two adjacent strands 14 and two adjacent transverse strands 15. As a result, the dimensions of the spaces 18 are in the range of approximately 1.5×1.5 mm to 15×15 mm, and preferably approximately 3×3 to 5×5 mm. Typically, after being compressed, the wall thickness of the identification surface 16 of the compressed section 21 is in the range of 0.3 to 1.0 mm.

The above detailed description of the preferred embodiments and the appended figures are for illustrative purposes only and are not intended to limit the scope and spirit of the invention, and its equivalents, as defined by the appended claims. One skilled in the art will recognize that many variations can be made to the invention disclosed in this specification without departing from the scope and spirit of the invention.

What is claimed is:

1. A method to produce a continuous thin-walled surface for containing information onto a synthetic mesh material used to protect transported items wherein the mesh material comprises first and second neighboring layers each having a plurality of parallel strands of a plastic material, with the parallel strands of the neighboring layers being not parallel to each other so as to form a mesh structure; the method comprising the steps of:

a) contacting a heated ram onto a selected area of the mesh structure for a sufficient time so as to at least partially soften the selected area; and b) pressing the heated ram onto the selected area of the mesh structure for a sufficient time at a sufficient pressure so as to deform the mesh structure into the continuous thin-walled surface.

2. The method as claimed in claim 1, wherein the first layer of parallel strands is perpendicular to the second layer of parallel strands.

3. The method as claimed in claim 2, wherein at least one item of information is stamped into the selected area during the pressing step.

4. The method as claimed in claim 2, wherein the parallel strands of the first layer and the parallel strands of the second layer have a diameter of 1.0 mm to 3.0 mm.

5. The method as claimed in claim 2, wherein the mesh structure has elastic characteristics and the thin-walled continuous surface retains at least a portion of the elastic characteristics of the mesh structure.

6. A method for making a thin-wall continuous surface for containing information on a synthetic material having a generally planar mesh structure having elastic characteristics and which is used to protect transported items comprising the steps of:

a) selecting the synthetic material having a mesh structure, wherein the mesh structure comprises first and second layers each layer having plurality of parallel strands, wherein the strands in the first layer of parallel strands are not parallel to the strands in the second layer of parallel strands to form the generally planar mesh structure; and b) compressing a defined portion of the mesh structure so as to permanently compress the defined portion of the mesh structure into the thin-walled continuous surface such that the thin-wall continuous surface retains at least a portion of the elastic characteristics of the mesh structure.

7. The method as claimed in claim 1, wherein the first layer of parallel strands is perpendicular to the second layer of parallel strands.

8. The method as claimed in claim 6, wherein at least one item of information is stamped into the defined portion during the compressing step.

9. The method as claimed in claim 6, wherein a ram is used to compress the defined portion of the mesh structure.

10. The method as claimed in claim 9, wherein the ram is heated, and the heated ram softens the defined portion of the mesh structure thus allowing the compression of the mesh structure into the thin-walled continuous surface.

11. The method as claimed in claim 9, wherein the synthetic material of the mesh structure is a plastic material, and the mesh structure is deformed in the defined portion in such a manner that the mesh structure in the defined portion of the mesh structure is eliminated and the thin-walled continuous surface is formed.

12. The method as claimed in claim 6, wherein the parallel strands of the first layer and the parallel strands of the second layer have a diameter of 0.5 mm to 5.0 mm.

13. The method as claimed in claim 12, wherein the distance between adjacent parallel strands in the first layer is 0.5 to 5.0 times the diameter of a strand and the distance between adjacent parallel strands in the second layer is 0.5 to 5.0 times the diameter of a strand.

14. The method as claimed in claim 6, wherein the parallel strands of the first layer and the parallel strands of the second layer have a diameter of 1.0 mm to 3.0 mm.

15. The method as claimed in claim 14, wherein the distance between adjacent parallel strands in the first layer is 0.5 to 5.0 times the diameter of a strand and the distance between adjacent parallel strands in the second layer is 0.5 to 5.0 times the diameter of a strand.

16. A method for making a thin-walled continuous surface for containing information on a synthetic material having a generally planar mesh structure and which is used to protect transported items comprising the steps of:

a) selecting the synthetic material having the mesh structure, wherein the mesh structure comprises first and second layers each having a plurality of parallel strands having a diameter of 0.5 to 5.0 mm, wherein the distance between adjacent parallel strands in each layer is 0.5 to 5.0 times the diameter of a strand in that layer, and wherein the strands in the first layer of parallel strands are not parallel to the strands in the second layer of parallel strands so as to form the generally planar mesh structure; and b) compressing a defined portion of the mesh structure so as to permanently compress the defined portion of the mesh structure into the thin-walled continuous surface, wherein the synthetic material of the mesh structure is a plastic material, and the mesh structure is deformed in the defined portion in such a manner that the mesh structure in the defined portion of the mesh structure is eliminated and the thin-walled continuous surface is formed.

17. The method as claimed in claim 16, wherein the first layer of parallel strands is perpendicular to the second layer of parallel strands.

18. The method as claimed in claim 16, wherein at least one item of information is stamped into the defined portion during the compressing step.

19. The method as claimed in claim 16, wherein the parallel strands of the first layer and the parallel strands of the second layer have a diameter of 1.0 mm to 3.0 mm.

20. The method as claimed in claim 16, wherein the mesh structure has elastic characteristics and the thin-walled continuous surface retains at least a portion of the elastic characteristics of the mesh structure.

21. A method to produce a thin-wall continuous surface for containing information onto a synthetic mesh material used to protect transported items wherein the mesh material has elastic characteristics and comprises first and second neighboring layers each having a plurality of parallel strands of a plastic material, with the parallel strands of the neighboring layers being not parallel to each other so as to form a mesh structure; the method comprising the steps of:

a) contacting a heated ram onto a selected area of the mesh structure for a sufficient time so as to at least partially soften the selected area; and b) pressing the heated ram onto the selected area of the mesh structure for a sufficient time at a sufficient pressure so as to deform the mesh structure into the continuous thin-walled surface such that the thin-wall continuous surface retains at least a portion of the elastic characteristics of the mesh structure.

22. The method as claimed in claim 21, wherein the first layer of parallel strands is perpendicular to the second layer of parallel strands.

23. The method as claimed in claim 21, wherein the mesh structure is deformed in the selected area in such a manner that the mesh structure in the selected area of the mesh structure is eliminated and the thin-walled continuous surface is formed.

24. The method as claimed in claim 21, wherein at least one item of information is stamped into the selected area during the pressing step.

25. The method as claimed in claim 21, wherein the parallel strands of the first layer and the parallel strands of the second layer have a diameter of 0.5 mm to 5.0 mm.

26. The method as claimed in claim 25, wherein the distance between adjacent parallel strands in the first layer is 0.5 to 5.0 times the diameter of a strand and the distance between adjacent parallel strands in the second layer is 0.5 to 5.0 times the diameter of a strand.

27. The method as claimed in claim 21, wherein the parallel strands of the first layer and the parallel strands of the second layer have a diameter of 1.0 mm to 3.0 mm.

28. The method as claimed in claim 27, wherein the distance between adjacent parallel strands in the first layer is 0.5 to 5.0 times the diameter of a strand and the distance between adjacent parallel strands in the second layer is 0.5 to 5.0 times the diameter of a strand.

* * * * *